United States Patent [19]

Kitazima et al.

[11] Patent Number: 4,532,506

[45] Date of Patent: Jul. 30, 1985

[54] MATRIX DISPLAY AND DRIVING METHOD THEREFOR

[75] Inventors: Masaaki Kitazima, Hitachiota; Hideaki Kawakami, Mito, both of Japan

[73] Assignee: Hitachi, Ltd., Tokyo, Japan

[21] Appl. No.: 427,585

[22] Filed: Sep. 29, 1982

[30] Foreign Application Priority Data

Oct. 30, 1981 [JP] Japan ..... 56-172733

[51] Int. Cl.[3] ..... G09G 3/30

[52] U.S. Cl. ..... 340/784; 340/752; 340/719; 340/781; 340/805

[58] Field of Search ..... 340/718, 719, 781, 825.81, 340/784, 805; 315/169.3

[56] References Cited

U.S. PATENT DOCUMENTS

| | | | |
|---|---|---|---|
| 3,654,606 | 4/1972 | Marlowe et al. | 340/784 |
| 3,862,360 | 1/1975 | Dill et al. | 340/719 |
| 4,006,383 | 2/1977 | Luo et al. | 340/825.81 |
| 4,042,854 | 8/1977 | Luo et al. | 340/825.81 |
| 4,110,664 | 8/1978 | Asars et al. | 340/781 |
| 4,114,070 | 9/1978 | Asars | 340/781 |
| 4,349,816 | 9/1982 | Miller et al. | 340/781 |

*Primary Examiner*—Marshall M. Curtis

*Attorney, Agent, or Firm*—Antonelli, Terry & Wands

[57] ABSTRACT

A matrix display comprises: a plurality of picture cells generally arranged in a matrix, the picture cells being defined by a plurality of first electrodes arranged on a first substrate and at least one common electrode arranged on a second substrate and a display medium held therebetween; a plurality of first signal lines and a plurality of second signal lines crossing to the first signal lines, arranged on at least one of the first and second substrates; a plurality of first semiconductor switches each having a control terminal, a first main terminal and a second main terminal, a plurality of second semiconductor switches each having a control terminal, a first main terminal and a second main terminal, and a plurality of storage means, arranged at respective crosspoints of the first signal lines and the second signal lines; each of the first signal lines being connected to the control terminal of the associated one of the first semiconductor switches and the first main terminal of the associated one of the second semiconductor switches; each of the second signal lines being connected to the first main terminal of the associated one of the first semiconductor switches; each of the second main terminals of the first semiconductor switches being connected to the associated one of the storage means and the control terminal of the associated one of the second semiconductor switches; and each of the second main terminals of the second semiconductor switches being connected to the associated one of the first electrodes.

16 Claims, 11 Drawing Figures

MATRIX DISPLAY AND DRIVING METHOD THEREFOR

The present invention relates to a matrix display, and more particularly to a matrix display and a driving method therefor capable of reducing the number of wires in a circuit and simplifying a drive circuit.

Figure 1:
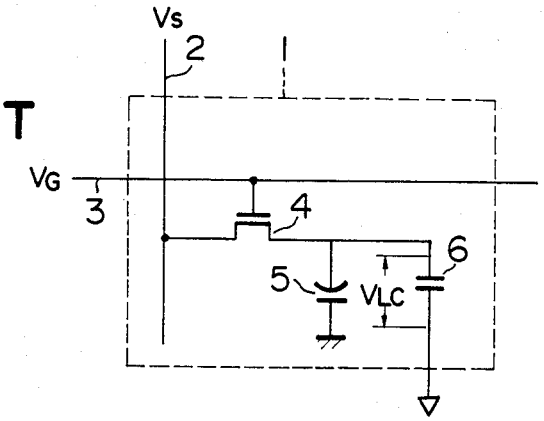
FIG. 1 PRIOR ART

In a liquid crystal matrix display, a method for independently driving respective liquid crystal picture cells has been known. For example, U.S. Pat. No. 3,654,606 discloses a drive method which uses MOS-FET's as switching elements for drive voltages. In such prior art, a display element comprises a MOS field effect transistor (MOS-FET) 4, a capacitor 5 and a picture cell 6, as shown in FIG. 1.

Figure 2:
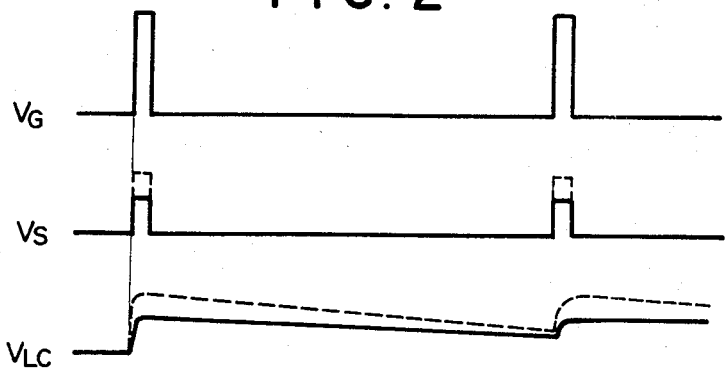

To drive the element, a gate voltage $V_G$ is applied to a gate signal line 3 to turn on the MOS-FET 4 and a voltage $V_s$ to excite the liquid crystal of the picture cell 6 is applied to a source signal line 2. By changing a level of the source voltage $V_s$ applied to the source signal line 2, a voltage $V_{LC}$ applied to the picture cell 6 changes as shown in FIG. 2, and a brightness of the liquid crystal can be controlled by a magnitude of a RMS voltage so that a gray scale display like a television image is attained.

In this drive method, since a discharge time constant of the liquid crystal is small, the storage capacitor 5 is connected in parallel with the picture cell 6 to enable an increase of the time constant with the effective voltage being applied to the liquid crystal being increased. Since a capacitance of the storage capacitor 5 must be several tens times as large as that of the picture cell 6, a large space is required for the storage capacitor 5.

Therefore, a variance of the capacitance and a defect of the storage capacitor may cause a problem. Even in a two-level display in which the liquid crystal is turned on and off, the capacitance of the storage capacitor must be sufficiently large.

Accordingly, a stable drive circuit which is not influenced by the discharge time constant of the liquid crystal display has been desired.

The same problem is encountered in the displays other than liquid crystal display, such as PLZT, EC or EL displays.

It is an object of the present invention to provide a matrix display which can be driven by a simple circuit without being influenced by the discharge time constant of the display medium and a method for driving the same.

In order to achieve the above object, according to the present invention, picture cells generally arranged in a matrix are defined by a plurality of first electrodes arranged on a first substrate and a common electrode arranged on a second substrate, and display medium held therebetween. A plurality of first signal lines and a plurality of second signal lines which cross with the first signal lines are arranged on at least one of the first and second substrates. A first semiconductor switch having at least a control terminal, a first main terminal and a second main terminal, and a second semiconductor switch having at least a control terminal, a first main terminal and a second main terminal, and storage means are arranged at each of crosspoints of the first signal lines and the second signal lines. Each of the first signal lines is connected to the control terminal of the corresponding first semiconductor switch and the first main terminal of the corresponding second semiconductor switch, and each of the second signal lines is connected to the first main terminal of the corresponding first semiconductor switch, the second main terminal of the first semiconductor switch is connected to the storage means and the control terminal of the second semiconductor switch, and the second main terminal of the second semiconductor switch is connected to the corresponding first electrode.

The other objects and features of the present invention will be apparent from the following description of the preferred embodiments.

Figure 3:
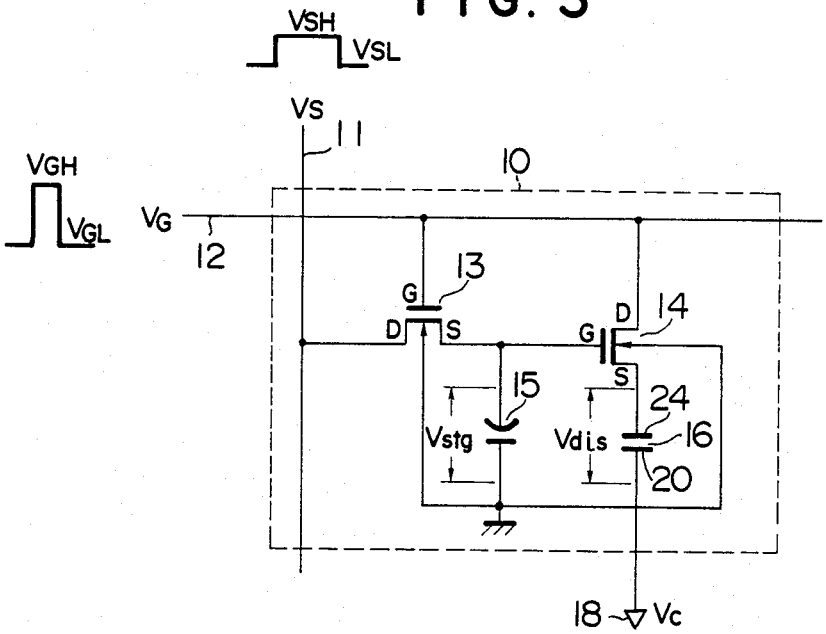
Figure 4A:
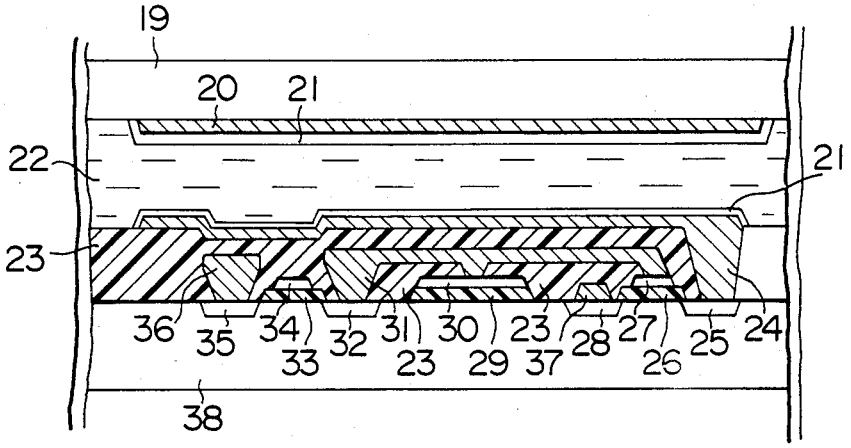
Figure 4B:
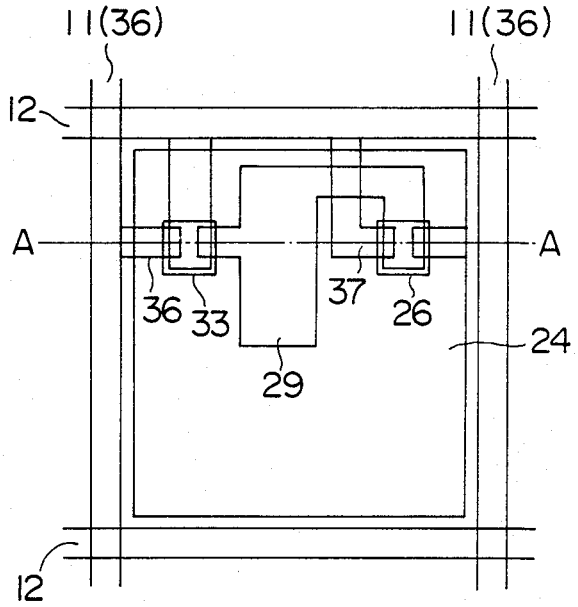
Figure 5:
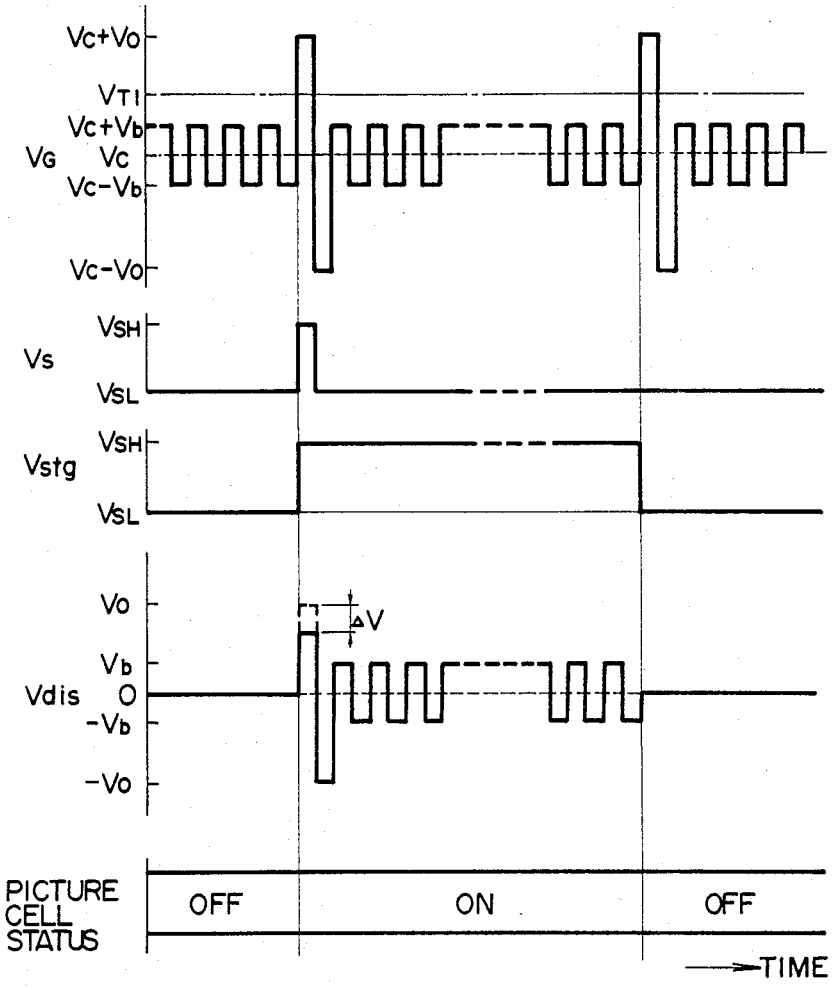
Figure 6:
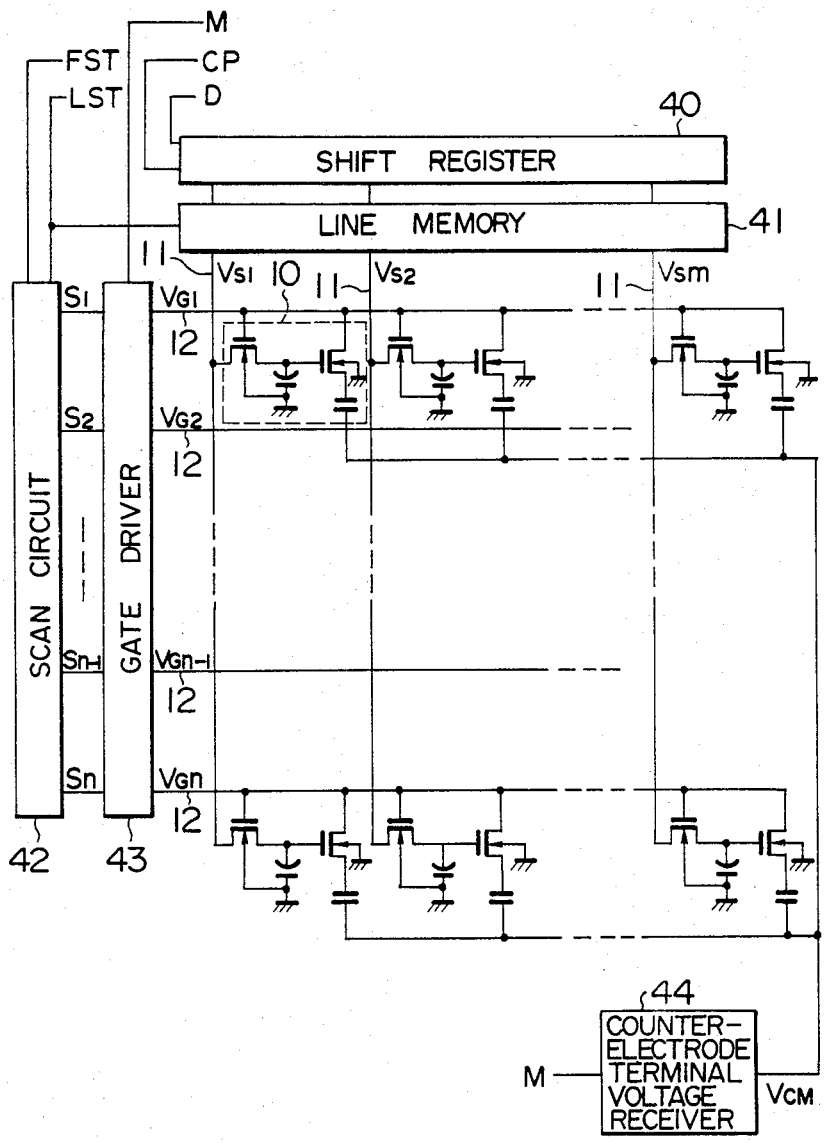
Figure 7:
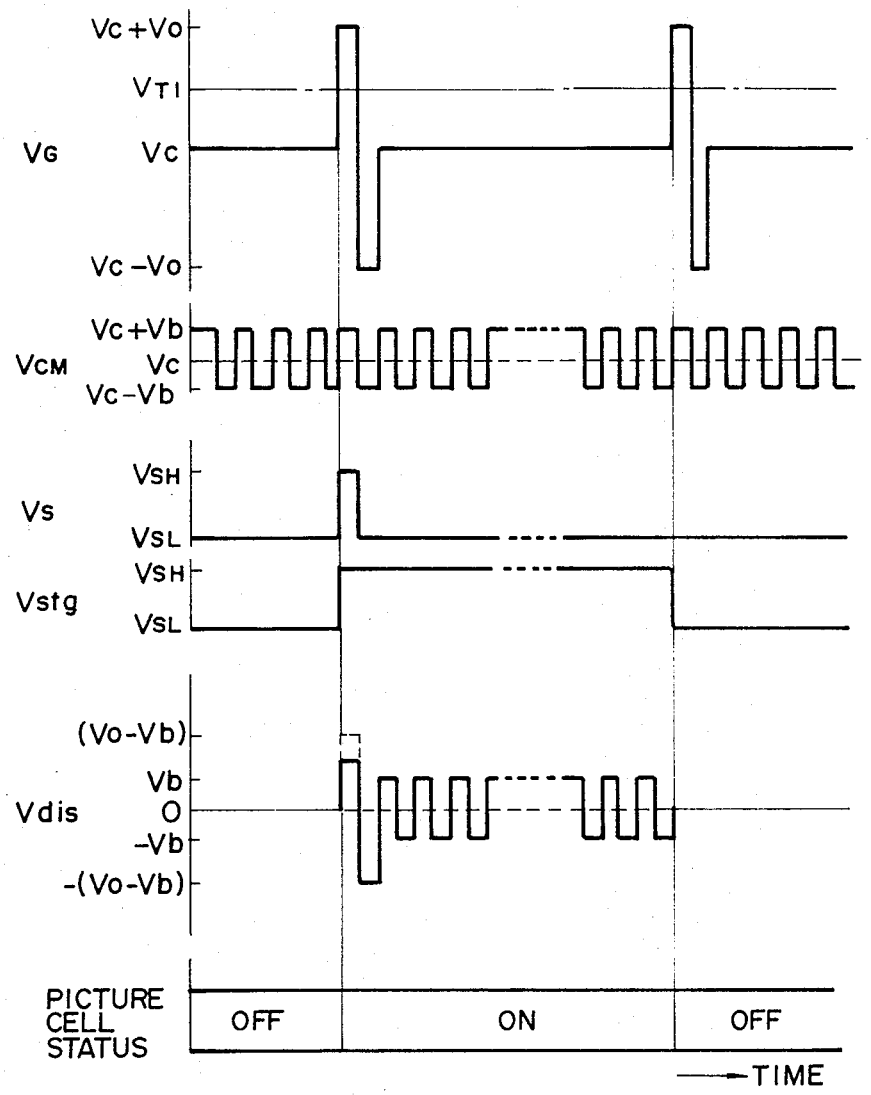
Figure 8:
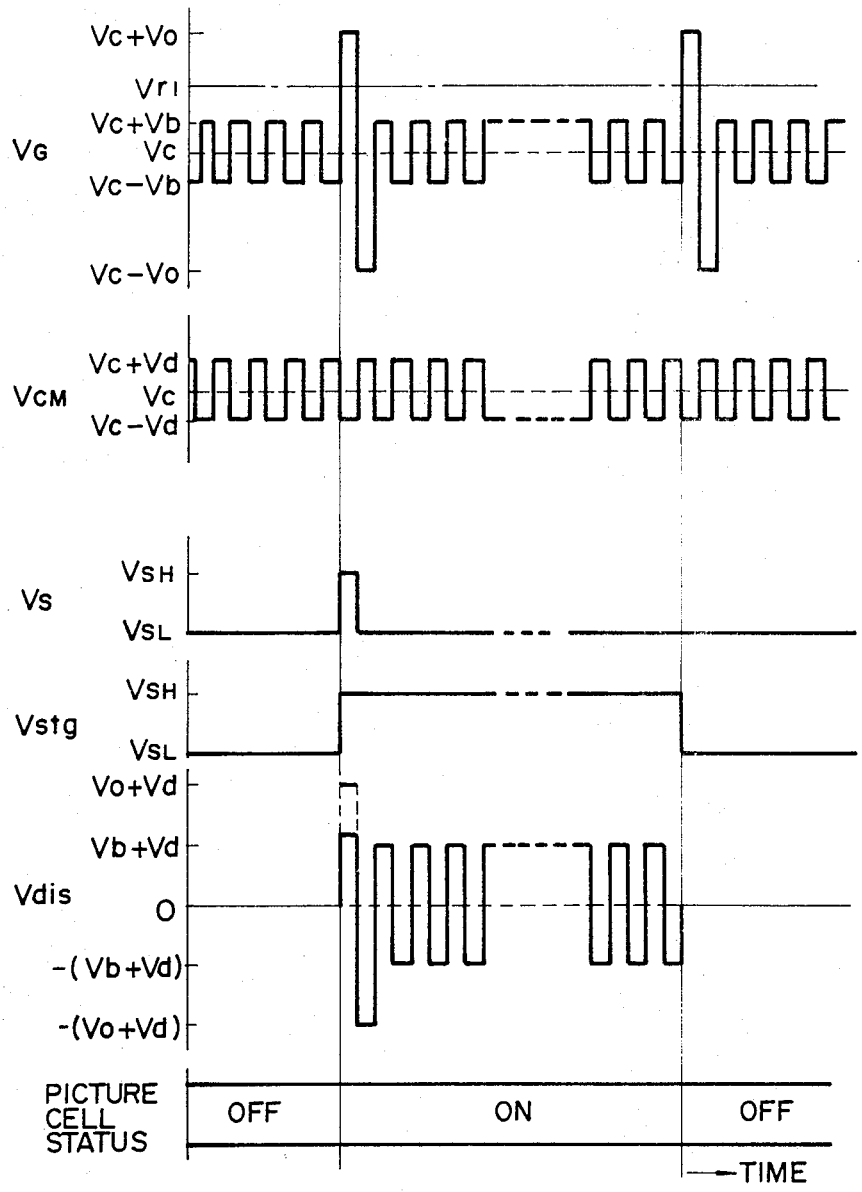
Figure 9:
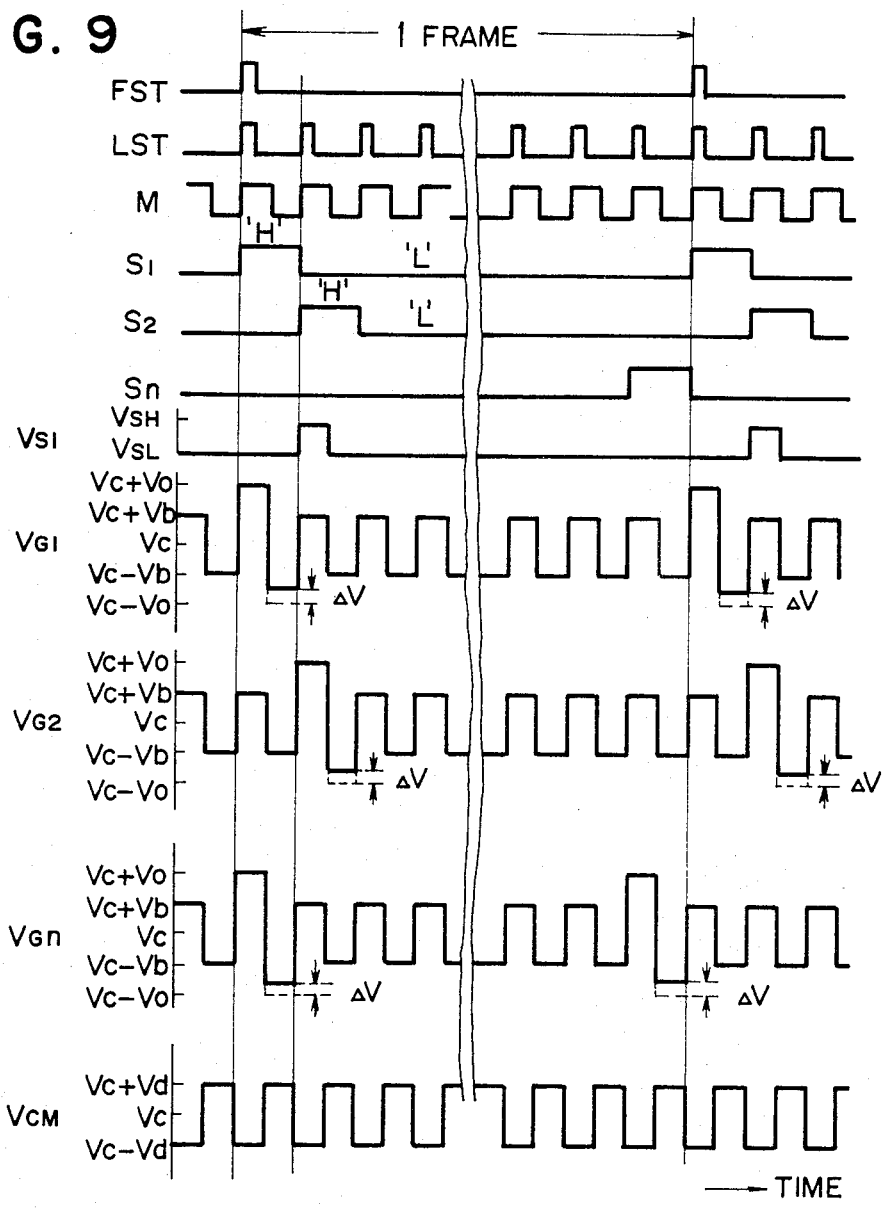
Figure 10:
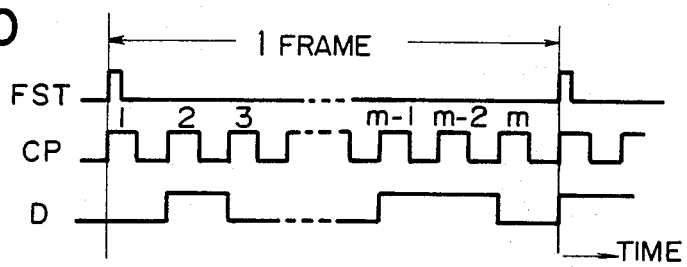

FIG. 1 shows a configuration of a prior art display element,

FIG. 2 shows waveforms for explaining the operation of the circuit of FIG. 1, FIG. 3 shows one embodiment of a matrix display of the present invention, FIG. 4*a* shows a sectional view of the embodiment shown in FIG. 3, FIG. 4*b* shows a plan view of the silicon substrate 38 of FIG. 4*a*, FIG. 5 shows a first embodiment of a drive method of the present invention, FIG. 6 shows one embodiment of the matrix display of the present invention, FIGS. 7 and 8 show second and third embodiments of the drive method of the present invention, and FIGS. 9 and 10 show a fourth embodiment of the drive method of the present invention.

The preferred embodiments of the present invention are now explained in detail.

EMBODIMENT 1

FIG. 3 shows a configuration of one embodiment of the present invention.

A display element 10 comprises a first MOS-FET 13 which is first semiconductor switch, a second MOS-FET 14 which is a second semiconductor switch, a capacitor 15 which is storage means and a picture cell 16. The picture cell 16 is formed by a space defined by a first electrode 24 and a common electrode 20 and liquid crystal which is a display medium held in the space. An N-channel MOS-FET is considered here as the semiconductor switch.

A gate terminal G of the first MOS-FET 13 is connected to a gate signal line 12, a drain terminal D thereof is connected to a source signal line 11 and a source terminal S thereof is connected to the capacitor 15 and a gate terminal G of the second MOS-FET 14. The first MOS-FET 13 is turned on and off by a gate voltage $V_G$ on the gate signal line 12. When the first MOS-FET 13 is turned on, a source voltage $V_s$ on the source signal line 11 is charged in the capacitor 15.

On the other hand, the gate terminal G of the second MOS-FET is connected to the source terminal S of the first MOS-FET 13 as described above, a drain terminal D thereof is connected to the gate signal line 12 and a source terminal S thereof is connected to first electrode 24 of the picture cell 16.

The second MOS-FET 14 is turned on when a voltage $V_{stg}$ charged in the capacitor 15 is sufficiently higher than a threshold voltage of the second MOS-FET 14. As a result, the voltage $V_G$ on the gate signal line 12 is applied to the picture cell 16. When the charge voltage $V_{stg}$ of the capacitor 15 is sufficiently lower than the threshold voltage of the second MOS-FET 14, the second MOS-FET 14 is turned off so that a voltage across the picture cell 16 assumes approximately zero.

Thus, in the present embodiment, since it is sufficient to charge the capacitor 15 by a higher voltage (peak value) than the threshold voltage of the second MOS-FET 14, the capacitor 15 may be of smaller capacitance than the prior art storage capacitor and hence it occupies a smaller area. In addition, since the gate terminal G of the first MOS-FET 13 and the drain terminal D of the second MOS-FET 14 are connected in common to the gate signal line 12, the wiring of the signal lines is simplified.

FIG. 4*a* shows a secttional view of a display panel in accordance with the display element circuit shown in FIG. 3. In FIG. 4*a*, the elements are formed on a P-type silicon substrate 38. FIG. 4*b* shows a plan view of the silicon substrate 38 of FIG. 4*a*. N+ diffusion layers 35, 32 and 28, 25 serve as the drains D and the sources S, respectively, of the first MOS-FET 13 and the second MOS-FET 14, respectively, and poly-silicon layers 34 and 27 on gate oxidization films 33 and 26, respectively, serve as the gate terminals G of the first MOS-FET 13 and the second MOS-FET 14, respectively. A field oxidization film 29 under a poly-silicon layer 30 serves as the capacitor 15 which is the storage means. The N+ diffusion layer 32 and the poly-silicon layers 27 and 30 are electrically connected by an A1 conductor 31. On the other hand, an A1 conductor 36 serves as the source signal line 11 and an A1 electrode 24 serves as the one electrode 24 of the picture cell 16. Numeral 37 denotes an A1 conductor which connects the drain D of the second MOS-FET 14 to the gate signal line 12. A protection film 21 is formed on the electrode 24. The respective conductors are insulated by insulation films 23.

On the other hand, a transparent common electrode 20 formed on a glass substrate 19 serves as the other electrode of the picture cell 16. This electrode is connected to a terminal 18.

A liquid crystal 22 may be a known liquid crystal such as nematic liquid crystal, nematic liquid crystal+dichromatic dye, cholesteric-nematic phase change liquid crystal+dichromatic dye or keiral nematic liquid crystal+dichromatic dye.

Conditions for voltage levels of the voltage $V_s$ applied to the source signal line 11 and the voltage $VG_G$ applied to the gate signal line 12 shown in FIG. 3 are now explained. $V_{GH}$ and $V_{GL}$ denote a high level and a low level, respectively of the voltage $V_G$ applied to the gate signal line 12, and $V_{SH}$ and $V_{SL}$ denote a high level and a low level, respectively, of the voltage $V_s$ applied to the source signal line 11. $V_{T1}$ denotes the threshold voltage of the first MOS-FET 13 and $V_{T2}$ denotes the threshold voltage of the second MOS-FET 14. $V_{GL}$ denotes a voltage to excite the liquid crystal. Since no voltage drop should be included in a path of $V_{GL}$, the following relation must be met to operate the second MOS-FET 14 in a non-saturation region when it is turned on.

$$V_{stg}-V_{T2}>V_{GL} \quad (1)$$

where $V_{stg}$ is the voltage across the capacitor 15.

When the relation (1) is met, the voltage $V_{GL}$ is conveyed to the picture cell 16 without substantial voltage drop.

In order to operate the first MOS-FET in a non-saturation region, the following relation must be met.

$$V_{GH}-V_{T1}>V_{SH} \quad (2)$$

In order for the first MOS-FET 13 to be cut off at $V_{GL}$, the following relation must be met.

$$V_{T1}>V_{GL} \quad (3)$$

When the voltage $V_{GH}$ is applied to the gate terminal G of the first MOS-FET 13, the voltage $V_{stg}$ across the capacitor 15 is $V_{SH}$. From the relations (1) and (2), $V_{GH}$ is defined as follows:

$$V_{GH}>V_{T1}+V_{T2}+V_{GL} \quad (4)$$

Accordingly, when the relations (3) and (4) are met, the voltage at the one electrode 24 of the picture cell 16 is $V_{GL}$ or it is floating. In the former case, the picture cell 16 is on, and in the latter case, the picture cell 16 is off.

Specific examples of the voltage $V_G$ applied to the gate signal line, the voltage $V_s$ applied to the source signal line, the capacitor voltage $V_{stg}$, the counterelectrode terminal voltage $V_{CM}$ and the voltage $V_{dis}$ across the picture cell 16, shown in FIG. 3 are explained below.

FIG. 5 shows a first embodiment of the drive method of the present invention.

In FIG. 5, the voltage $V_G$ applied to the gate signal line comprises a portion changing by $\pm V_b$ from $V_c$ and a portion changing by $\pm V_o$ from $V_c$. The former is a voltage to excite the liquid crystal which is the display medium, and of the latter, $V_c+V_o$ is a voltage to turn on the first MOS-FET 13 and $V_c \pm V_o$ is a voltage to A.C.-drive the liquid crystal.

When the gate voltage $V_G$ is $V_c+V_o$ ($=V_{GH}$), the capacitor voltage $V_{stg}$ is $V_{SH}$ when the voltage $V_s$ applied to the source signal line is $V_{SH}$, and the capacitor voltage $V_{stg}$ is $V_{SL}$ when $V_s$ is $V_{SL}$. In the former case, the second MOS-FET 14 is turned on, and in the latter case, it is turned off.

On the other hand, when the counterelectrode terminal voltage $V_{CM}$ is $V_c$ (=constant voltage), the voltage $V_{dis}$ applied to the picture cell 16 comprises the voltage $\pm V_b$ and one cycle of unbalanced voltage level portion, because the voltage $V_c+V_o$ which is high enough to operate the second MOS-FET 14 in a saturation region is applied to the drain terminal D thereof and hence the voltage at the source S of the second MOS-FET 14 is cut by $\Delta V$. As a result, a D.C. voltage component of $\Delta V/2N$ is applied to the liquid crystal, where N is a reciprocal of a duty factor.

When $\Delta V$ is 5 volts and N is 200, for example, the D.C. voltage component is 25 mV, which does not raise any practical problem.

The picture cell 16 assumes one of an on-state and off-state depending on the level of the voltage $V_{dis}$. A RMS voltage $V_{s1}$ when the picture cell 16 is on is given by $$V_{sl}=\sqrt{\frac{1}{2N}(V_o-\Delta V)^2+\frac{1}{2N}V_o^2+\frac{N-1}{N}V_b^2}$$

Thus, $V_b$ should be selected such that $V_{s1}$ is larger than the threshold voltage of the liquid crystal which is the display medium.

FIG. 6 shows an embodiment of the overall matrix display of the present invention.

An image signal D is converted from a serial form to a parallel form by a shift register 40 in synchronism with a clock pulse Cp and the parallel signal is temporarily stored in a line memory 41 as voltages $V_{s1}-V_{sm}$ to be applied to the source signal lines.

On the other hand, a scan circuit 42 generates scan signals $S_1-S_n$ in synchronism with a frame start signal FST and a line start signal LST, and a gate driver 43 generates voltages $V_{G1}-V_{Gn}$ to be applied to the gate signal lines. The image data is written in the capacitor in each of the display elements 10 in a sequential line scan system.

A counterelectrode terminal voltage generator 44 generates the counterelectrode terminal voltage $V_{CM}$ in synchronism with a signal M.

EMBODIMENT 2

FIG. 7 shows a second embodiment of the drive method of the present invention. In the waveforms shown in FIG. 7, the counterelectrode terminal voltage $V_{CM}$ is changed by $\pm V_b$ from $V_c$. The voltage finally applied to the picture cell 16 is same as that in FIG. 5.

EMBODIMENT 3

FIG. 8 shows a third embodiment of the drive method of the present invention. In the waveforms shown in FIG. 8, the voltage $V_G$ applied to the gate signal line 12 and the counterelectrode terminal voltage $V_{CM}$ for producing the exciting voltage to the liquid crystal which is the display medium are A.C. voltages. As a result, the voltage $V_b$ of the voltage $V_G$ applied to the gate signal line 12 may be lower than that in FIG. 5 or FIG. 7.

EMBODIMENT 4

FIGS. 9 and 10 show a fourth embodiment of the drive method of the present invention and show a time chart for the signals shown in FIG. 6. The voltages $V_{G1}-V_{Gn}$ applied to the gate signal lines and the counterelectrode terminal voltage $V_{CM}$ may be those shown in the third embodiment or they may be those shown in the first or second embodiment.

When the voltages $V_{G1}-V_{G2}$ applied to the gate signal lines are $V_c+V_b$, the voltages $V_{S1}-V_{Sm}$ applied to the source signal line 11 are $V_{SH}$ or $V_{SL}$. As a result, the picture elements 16 are turned on or off.

The voltage $V_{dis}$ shown in FIG. 5 is unbalanced by $\Delta V$. In accordance with the present embodiment, since the voltage $V_c-V_o$ of the gate voltage $V_G$ is increased by $\Delta V$ or to voltage $V_c-V_o+\Delta V$ so that the D.C. voltage component is not applied to the picture cell, the problem of application of the D.C. voltage component to the liquid crystal can be resolved. The same is true for the waveforms of FIG. 5 and FIG. 7.

While the liquid crystal has been described as the display medium in the present embodiment, the display medium is not limited thereto but other display media such as PLZT, EC and EL may be used in the present invention.

The present invention is not limited to the MOS-FET but other three-terminal semiconductor switch having input, output and control terminals such as a junction type FET or a bipolar transistor may be used.

Furthermore, the present invention is not limited to a common electrode but a plurality of common electrodes may be used.

As described hereinabove, according to the present invention, the size of the storage means can be reduced. In addition, according to the present invention, the stable drive voltage can be generated without being affected by the property of the liquid crystal of small discharge time constant so that a high contrast and a fast operation speed can be attained.

Furthermore, since the drive system uses the mixture of the excitation voltage of the display medium and the scan voltage, the wiring of the signal lines can be very simplified and a highly reliable display panel can be provided.

We claim:

1. A matrix display comprising:

a plurality of picture cells generally arranged in a matrix, said picture cells being defined by a plurality of first electrodes arranged on a first substrate and at least one common electrode arranged on a second substrate and a display medium held therebetween;

a plurality of first signal lines and a plurality of second signal lines crossing said first signal lines, arranged on at least one of said first and second substrates;

a plurality of first semiconductor switches each having a control terminal, a first main terminal and a second main terminal, a plurality of second semiconductor switches each having a control terminal, a first main terminal and a second main terminal, and a plurality of storage means, arranged at respective crosspoints of said first signal lines and said second signal lines;

each of said first signal lines being connected to said control terminal of the associated one of said first semiconductor switches and said first main terminal of the associated one of said second semiconductor switches;

each of said second signal lines being connected to said first main terminal of the associated one of said first semiconductor switches;

each of said second main terminals of said first semiconductor switches being connected to the associated one of said storage means and said control terminal of the associated one of said second semiconductor switches; and each of said second main terminals of said second semiconductor switches being connected to the associated one of said first electrodes.

2. A matrix display according to claim 1 wherein said display medium is liquid crystal.

3. A matrix display according to claim 1, wherein said first and second semiconductor switches are field effect transistors.

4. In a matrix display comprising:

a plurality of picture cells generally arranged in a matrix, said picture cells being defined by a plurality of first electrodes arranged on a first substrate and at least one common electrode arranged on a second substrate and a display medium held therebetween;

a plurality of first signal lines and a plurality of second signal lines crossing said first signal lines, arranged on at least one of said first and second substrates;

a plurality of first semiconductor switches each having a control terminal, a first main terminal and a second main terminal, a plurality of second semiconductor switches each having a control terminal, a first main terminal and a second main terminal, and a plurality of storage means, arranged at respective crosspoints of said first signal lines and said second signal lines;

each of said first signal lines being connected to said control terminal of the associated one of said first semiconductor switches and said first main terminal of the associated one of said second semiconductor switches;

each of said second signal lines being connected to said first main terminal of the associated one of said first semiconductor switches;

each of said second main terminals of said first semiconductor switches being connected to the associated one of said storage means and said control terminal of the associated one of said second semiconductor switches; and each of said second main terminals of said second semiconductor switches being connected to the associated one of said first electrodes;

means for applying a larger voltage $V_{GH}$ than a threshold voltage $V_{T1}$ of said first semiconductor switches to selected ones of said first signal lines while applying a smaller voltage $V_{GL}$ than said threshold voltage $V_{T1}$ to non-selected ones of said first signal lines; and means for applying a larger voltage $V_{SH}$ than a threshold voltage $V_{T2}$ of said second semiconductor switches to selected ones of said second signal lines while applying a smaller voltage $V_{SL}$ than said threshold voltage $V_{T2}$ to non-selected ones of said second signal lines.

5. A matrix display according to claim 4 wherein a mean voltage applied to said display medium is zero volt.

6. A matrix display according to claim 4 wherein $$V_{GH} > V_{T1} + V_{T2} + V_{GL}.$$

7. A matrix display according to claim 4 wherein a voltage for exciting said display medium is superimposed on at least one of the voltage applied to said first signal lines and the voltage applied to said common electrode.

8. A matrix display according to claim 4, 5, 6 or 7 wherein said display medium is liquid crystal.

9. A matrix display according to claim 4, 5, 6 or 7 wherein said first and second semiconductor switches are field effect transistors.

10. In a matrix display comprising:

a plurality of picture cells generally arranged in a matrix, said picture cells being defined by a plurality of first electrodes arranged on a first substrate and at least one common electrode arranged on a second substrate and a display medium held therebetween;

a plurality of first signal lines and a plurality of second signal lines crossing said first signal lines, arranged on at least one of said first and second substrates;

a plurality of first semiconductor switches each having a control terminal, a first main terminal and a second main terminal, a plurality of second semiconductor switches each having a control terminal, a first main terminal and a plurality of storage means, arranged at respective crosspoints of said first signal lines and said second signal lines;

each of said first signal lines being connected to said control terminal of the associated one of said first semiconductor switches and said first main terminal of the associated one of said second semiconductor switches;

each of said second signal lines being connected to said first main terminal of the associated one of said first semiconductor switches;

each of said second main terminals of said first semiconductor switches being connected to the associated one of said storage means and said control terminal of the associated one of said second semiconductor switches; and each of said second main terminals of said second semiconducutor switches being connected to the associated one of said first electrodes;

a drive method for said matrix display comprising the steps of;

applying a first voltage signal to control the on-state and the off-state of said first semiconductor switches and a second voltage signal to excite said display medium in superposition to said first signal lines; and applying a third voltage signal to control the on-state and the off-state of said second semiconductor switches to said second signal lines.

11. A drive method for a matrix display according to claim 10 wherein said display medium is liquid crystal.

12. A drive method for a matrix display according to claim 10 wherein said first and second semiconductor switches are field effect transistors.

13. A drive method for a matrix display according to claim 10, wherein the on-state and the off-state of said second semiconductor switches are controlled only by applying said third voltage signal to said second signal lines.

14. A matrix display according to claim 1, further comprising:

means for applying a voltage signal to control the on-state and the off-state of said first semiconductor switches and a voltage signal to excite said display medium in superposition to said first signal lines; and means for applying a voltage signal to control the on-state and the off-state of said second semiconductor switches to said second signal lines.

15. A matrix display according to claim 14, wherein said display medium is liquid crystal.

16. A matrix display according to claim 14, wherein said first and second semiconductor switches are field effect transistors.

* * * * *